US005381813A

United States Patent [19]

Miric et al.

[11] Patent Number: 5,381,813

[45] Date of Patent: Jan. 17, 1995

[54] ADJUSTABLE HADN GRIP FOR ORTHOPEDIC CRUTCH

[75] Inventors: Zivko Miric, Northridge; Cuong Bui, Yorba Linda; Stephen J. Eynon, Moorpark, all of Calif.

[73] Assignee: Guardian Products, Inc., Arleta, Calif.

[21] Appl. No.: 144,183

[22] Filed: Oct. 27, 1993

Related U.S. Application Data

[63] Continuation-in-part of Ser. No. 1,830, Jan. 8, 1993, Pat. No. 5,291,910, which is a continuation-in-part of Ser. No. 881,531, May 12, 1992, Pat. No. 5,299,589.

[51] Int. Cl.[6] ..... A61H 3/02

[52] U.S. Cl. ..... 135/72; 135/76

[58] Field of Search ..... 135/68, 72, 76, 67, 135/70

[56] References Cited

U.S. PATENT DOCUMENTS

| | | | |
|---|---|---|---|
| 596,203 | 12/1897 | Drake . | |
| 705,741 | 7/1902 | Drew | 135/72 X |
| 904,481 | 11/1908 | Hood . | |
| 1,225,364 | 5/1917 | Sanders . | |
| 1,253,117 | 1/1918 | Allen . | |
| 1,446,009 | 2/1923 | Glowacki | 135/72 |
| 1,505,081 | 8/1924 | Arndt | 135/68 X |
| 2,110,397 | 3/1938 | Kangas . | |
| 2,208,796 | 7/1940 | Jaenichen et al. . | |
| 2,429,409 | 10/1947 | Eidman . | |
| 2,669,244 | 2/1954 | Greene et al. | 135/72 |
| 2,793,647 | 5/1957 | Urie et al. . | |
| 2,825,591 | 3/1958 | Mulder . | |
| 3,277,767 | 10/1966 | Allen et al. . | |
| 3,335,735 | 8/1967 | Colegrove et al. . | |
| 3,710,807 | 1/1973 | Ferag . | |
| 3,768,495 | 10/1973 | Smith . | |
| 4,054,396 | 10/1977 | Neuman . | |
| 4,476,885 | 10/1984 | Stein | 135/72 X |
| 4,596,484 | 6/1986 | Nakatami . | |
| 4,627,761 | 12/1986 | Olson et al. . | |
| 4,647,241 | 3/1987 | Weber . | |
| 4,753,259 | 6/1988 | Hansen et al. . | |
| 4,786,022 | 11/1988 | Grieshaber . | |
| 4,809,995 | 3/1989 | Ramunas . | |
| 4,979,533 | 12/1990 | Hansen et al. . | |

FOREIGN PATENT DOCUMENTS

| | | |
|---|---|---|
| 187555 | 7/1907 | Germany . |
| 702634 | 1/1954 | United Kingdom . |

OTHER PUBLICATIONS

A portion of an undated brochure showing elbow crutches manufactured by Gauthier-Villot and believed to be sold by Walk Easy, Inc.

*Primary Examiner*—Lanna Mai

*Attorney, Agent, or Firm*—Willian Brinks Hofer Gilson & Lione

[57] ABSTRACT

An adjustable hand grip is provided that can slide along the vertical supports of an orthopedic crutch. The hand grip can be easily fixed to the supports at different vertical elevations to accommodate the user by using a locking member that includes a pin that is biased inwardly into apertures provided on the vertical supports.

7 Claims, 2 Drawing Sheets

10
12
14
16
20
22
24
26
28
30
32
34
40
42
44
46
48
50
2

ADJUSTABLE HADN GRIP FOR ORTHOPEDIC CRUTCH

This application is a continuation-in-part application of U.S. Ser. No. 08/001,830 filed Jan. 8, 1993 now U.S. Pat. No. 5,291,910 which is a continuation-in-part of U.S. Ser. No. 07/881,531 filed on May 12, 1992 now U.S. Pat. No. 5,299,589, both of which are incorporated herein by reference.

BACKGROUND OF THE INVENTION

The present invention relates to an adjustable hand grip for an orthopedic crotch.

Many different orthopedic crotches have been designed and manufactured to assist injured and handicapped individuals. Since individual users vary in height, efforts have been made to design and construct orthopedic crotches which are adjustable to the height of the user. For example, U.S. Pat. No. 4,979,533 discloses a crutch having an adjustable hand grip with locking buttons biased outwardly by a spring to engage holes located in an adjustment mechanism.

For the most part such orthopedic crutches tend to require complex adjustment mechanisms and procedures to accomplish the hand grip adjustment. Moreover, in some cases, the hand grip when adjusted does not provide a feeling of security and stability for the user. Accordingly, while the hand grip should be adjustable it must also be stable.

The present invention provides an adjustable hand grip for an orthopedic crutch which is simple and easy to operate by the user without the need of assistance and which is stable and secure.

SUMMARY OF THE INVENTION

This invention is an orthopedic crutch comprising a pair of spaced apart, generally parallel vertical, preferably tubular, supports rigidly attached to one another, an arm support attached to the upper end of the vertical supports and a vertically adjustable hand grip fixable to the vertical supports. Each of the vertical supports has a plurality of spaced apart apertures along one longitudinal surface. The hand grip comprises tubular sleeves that surround and slide over each vertical support; and a bracket extending between the vertical supports rigidly connecting the sleeves. The sleeves accommodate a locking member extending through an aperture in the sleeve adjacent an aperture in the vertical support. The locking member for locking the sleeve to a vertical support comprises a pin that is biased inwardly by a biasing element through the aligned apertures in the sleeve and the vertical support and is moveable into and out of the apertures in the vertical support.

This invention allows for the quick, easy adjustment of the hand grip without difficult-to-adjust nuts and bolts used on prior handles.

DETAILED DESCRIPTION OF THE DRAWINGS

DETAILED DESCRIPTION OF THE PREFERRED EMBODIMENTS

Figures 1, 2, 3:
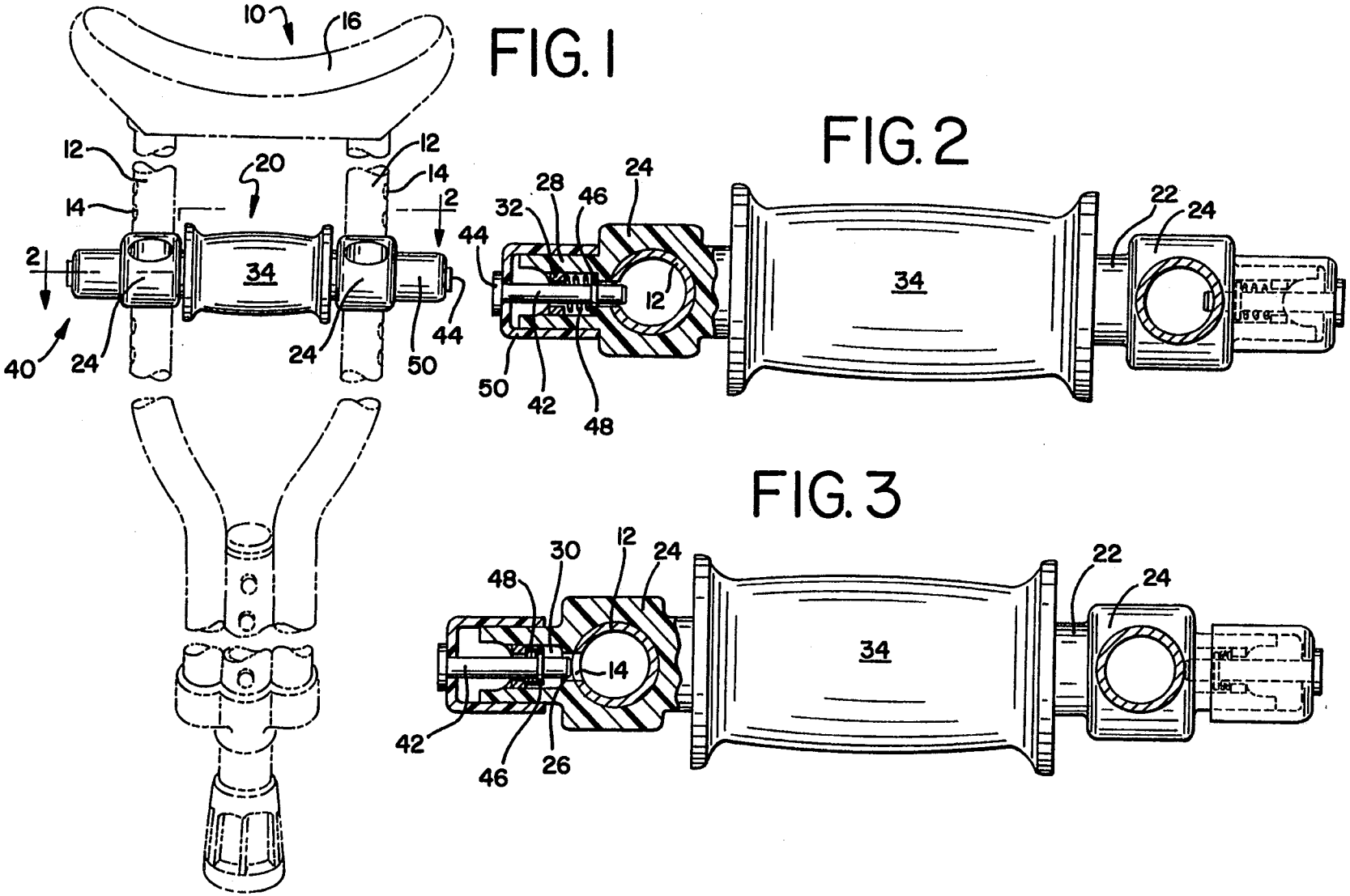
FIG. 1 is a perspective view that shows the adjustable hand grip mounted on an orthopedic crutch and shows the locking member in an engaged position with respect to the vertical supports.
FIG. 2 is a cross-sectional view of the adjustable hand grip of the present invention with the locking member in the engaged position.
FIG. 3 is a cross-sectional view of the adjustable hand grip of the present invention showing the locking member in the disengaged position.

One embodiment of the invention (FIGS. 1–3) is an orthopedic crutch 10 that includes a pair of generally parallel vertical supports 12 rigidly attached to one another, an arm support 16 attached to the upper ends of the vertical supports, and an adjustable hand grip 20 having a locking member 40 to lock the hand grip at any of several positions desired by the user. Preferably, the supports 12 are tubular. Alternatively, the supports 12 may be wooden or may be manufactured from an extruded polymeric material. Apertures 14 are provided by any known means on a longitudinal surface of the vertical supports 12 such as by being drilled, mandrel punched, or preferably free punched.

The hand grip 20 comprises a bracket 22 rigidly connecting sleeves 24 and an end portion 28 extending from the sleeves 24. The sleeves 24 are longitudinally slidable on the vertical supports 12, and are provided with apertures 26 that are alignable with the apertures 14 on the vertical supports. The inner circumference of the sleeves 24 generally conforms to the shape of the vertical supports 12. Advantageously, the sleeve 24 and bracket 22 may comprise a unitary molded plastic member of suitably rigid plastic material such as polypropylene. More preferably, the sleeve 24 and bracket 22 comprise a unitary plastic member molded from a nylon polymer.

A pad 34 preferably surrounds the bracket 22 to provide comfort for the user's hand. The pad 34 can be of a suitable foam material including foam rubber.

The locking member 40 comprises a pin 42 biased inwardly by a biasing element, preferably a spring 48 through the aligned apertures 26 and 14 to define an engaged position. The pin 42 is moveable into and out of the aperture 14 so that the hand grip 20 can be adjusted at any desirable height defined by the apertures. FIG. 2 shows the locking member 40 in the engaged or locked position wherein the pin 42 extends through the aperture 14 in the vertical support. Preferably, the pin 42 extends only a portion of the distance of the inner diameter of the vertical support. FIG. 3 shows the locking member 40 in the disengaged or unlocked position wherein the pin 42 does not extend through aperture 14 in the vertical support 12.

The pin 42 is preferably metallic since it engages the vertical supports which are also generally, and preferably, of metallic material. The pin 42 also preferably has a lead angle so that the pin may be easily received by the apertures in the vertical supports.

In the most preferred embodiment, the pin 42 is retained on an end cap 50 that surrounds the end portion 28 of the hand grip 20. The pin 42 may be retained on the end cap 50 in any suitable manner. For example, the pin 42 may be retained by providing an aperture 52 at the outermost portion of the end cap 50 to surround a pin having a head 44 with a diameter greater than the diameter of the aperture 52 on the end cap. In this way, when it is desired to disengage the locking member, the end cap 50 is grasped and pulled in a direction away from the sleeve 24 to compress the spring 48 against the stop 32 and to move the pin 42 out of the aperture 14 in the vertical sleeve.

The end portion 28 preferably has a cavity 30 defined by the sleeve 24 at one end and by a stop 32 provided at the other end. The cavity 30 receives the spring 48 and a portion of the pin 42. The spring 48 is disposed on a portion of the pin 42 between a stop 46 provided on the pin near its lead end and the stop 32 on the end portion so that the spring biases the pin 42 inward through aligned aperture 26 in the sleeve and aperture 14 in the vertical support. The stop 46 preferably has a greater diameter than the diameter of the aperture 26 provided on the sleeve so that the amount the pin 42 extends into the aperture will be limited.

To adjust the vertical elevation of the hand grip 20 with respect to the arm rest, to accommodate the user, the locking member 40 may be disengaged from the vertical supports 12 by grasping and pulling each cap 50 in an outward direction (i.e., away from the vertical support). When the locking member 40 is disengaged, the hand grip 20 can be moved along the vertical supports to a suitable position for the user. The caps 50 are then released so that the spring 48 biases the pin 42 through the closest aligned apertures in the sleeve and vertical support to a locking position.

Preferably, the spring 48 is such that the user is not required to exert undue force to disengage the locking member while at the same time the pin must not inadvertently "pop out" or become disengaged from the vertical supports. The force to disengage the pin is preferably at least about 5 pounds, more preferably from about 5 to about 15 pounds, most preferably from about 5 to about 7 pounds.

Since a majority of the crutch user's weight is to be supported by the hand grip 20, it is important that the hand grip, the bracket, the pin, and other components be able to sustain a minimum static load to ensure that they will not fail under the load of the user. In other words, the hand grip, the bracket, the pin, and other components should be able to withstand this minimum static load when the clamp is in the engaged position, as shown in FIG. 2, with the pin inserted through the aligned apertures in sleeves and vertical supports.

Figure 4:
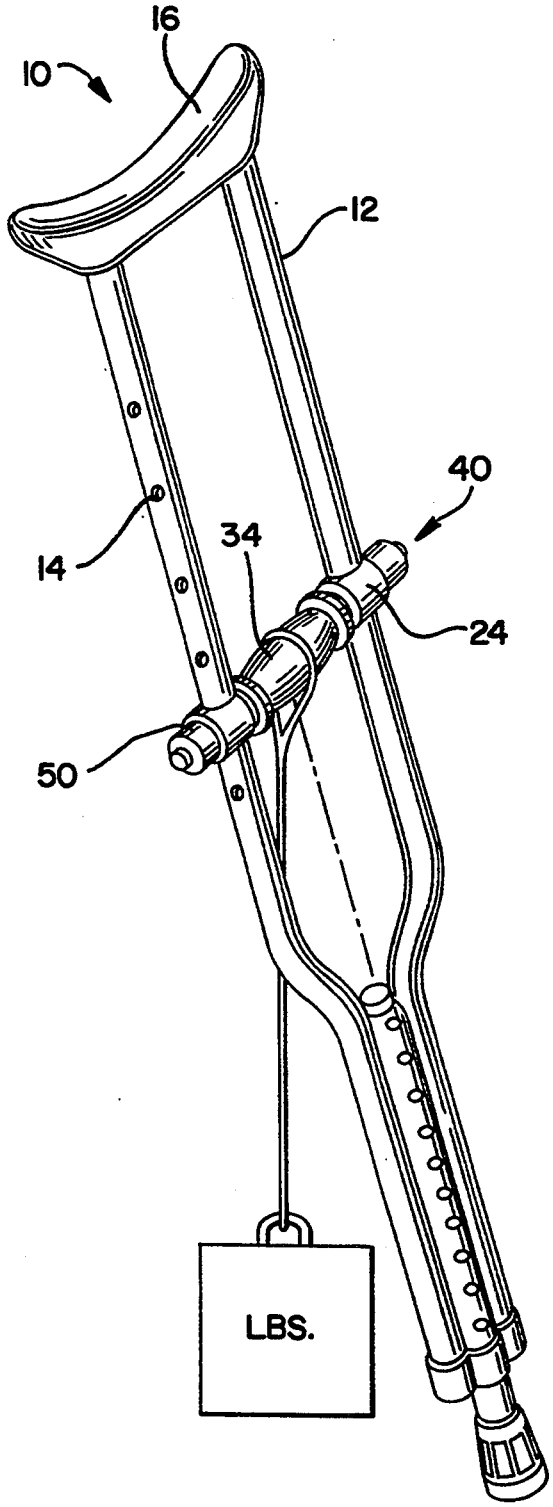
FIG. 4 is a perspective schematic showing the static load and dynamic load testing of the hand grip of FIG. 1.

Preferably, the hand grip 20 should be able to withstand this minimum static load at each of the vertical positions of the hand grip 20. Static load testing on the hand grip may be performed with the crutch oriented in a substantially vertical position. This position, however, does not accurately reflect the alignment of the crutch during the user's locomotion. Accordingly, it is preferred that static loading tests on the hand grip be performed when the crutch is oriented at about 15° from the vertical (see FIG. 4). Preferably, the hand grip in the present embodiment should withstand a minimum static load of at least 100 pounds, preferably, at least 150 pounds, more preferably, at least 200 pounds with the load applied vertically while the crutch is oriented at about 15° from the vertical without exhibiting any flexing of the vertical supports, damage to the hand grip, or undue enlargement of the apertures.

It is also important that the hand grip of the present embodiment be able to withstand the anticipated cyclical dynamic stresses applied by the user during locomotion without causing excessive enlargement of the apertures 14 provided in the vertical supports or fatigue of related components. Such enlargement may cause the user to feel that the hand grip is unstable. Accordingly, it is preferred that the hand grip withstand a load of at least 100 pounds, more preferably, at least 200 pounds when the crutch is oriented at about 15° from the vertical for a minimum of 200,000 cycles without excessive enlargement of the apertures, fatigue, failure, or damage to the hand grip, or other components of the crutch. Preferably, the apertures 14 provided in the vertical supports do not enlarge more than about 0.015 of an inch after the above described cyclic loading.

In another embodiment of the invention the vertical supports are manufactured from wood. Such a construction is shown and described in U.S. Pat. No. 5,291,910, and U.S. Pat. No. 5,299,589, both of which are assigned to the assignee of the present invention and both of which are incorporated herein by reference. Of course in this embodiment each of the vertical wood supports are provided with apertures on a longitudinal surface by any known means. It is also understood that the hand grip, particularly the sleeve, may have a differently shaped inner circumference suitable to slidably engage the wooden vertical support.

In another embodiment the vertical supports are manufactured from an extruded polymer or are integrally molded from plastic. In this embodiment, each of the vertical supports are provided with apertures on a longitudinal surface by any known means. Desirably the portion of the vertical support that slidably receives the sleeve is contoured to provide a mating relationship with the sleeve of the hand grip.

It is apparent from the foregoing that various changes and modifications may be made to the adjustable hand grip including the locking member according to the present invention without departing from the scope thereof and that it is the following claims including all equivalents, that define the invention.

What is claimed is:

1. An adjustable hand grip having a locking member for an orthopedic crotch with a pair of generally parallel, vertical supports rigidly attached to one another, with each of the supports having a plurality of spaced apertures along a longitudinal surface, comprising:
   a. a sleeve slidably surrounding each vertical support, each sleeve having an aperture that can be aligned with the apertures in the vertical support;
   b. a bracket extending between the vertical supports to rigidly connect the sleeves;
   c. an end portion extending from the sleeve;
   d. an end cap surrounding the end portion and retaining the pin; and,
   e. the locking member comprising a pin biased inwardly by a biasing element through the aligned apertures in the sleeve and the vertical support, the pin being movable into and out of the vertical support, the locking member firmly fixing the hand grip to the vertical supports when the pin is extended through the aligned apertures in the sleeve and the vertical support.

2. The adjustable hand grip according to claim 1 further having a cavity within the end portion defined by the sleeve at one end and by a stop at the other end, the cavity receiving the spring.

3. The adjustable hand grip according to claim 2 wherein the force required to disengage the pin from the aperture in the vertical support is at least 5 pounds.

4. An orthopedic crutch comprising:
   a. a pair of generally parallel, vertical tubular supports rigidly attached to one another, each of the tubular supports having a plurality of spaced apertures along a longitudinal surface;

b. an arm support attached to the upper ends of the vertical supports;

c. a hand grip comprising a tubular sleeve surrounding each vertical support and slidable thereover and a bracket extending between the vertical supports rigidly connecting said sleeves, each sleeve having an aperture alignable with apertures in a vertical support;

d. an end portion extending from the sleeve;

e. an end cap surrounding the end portion and retaining the pin; and, f. a locking member comprising a pin biased inwardly by a spring through the aligned apertures in the sleeve and the vertical support, the pin being movable into and out of the vertical support, the locking member firmly fixing the hand grip to the vertical supports when the pin is extended through the aligned apertures in the sleeve and the vertical support with the hand grip being vertically adjustable by moving the pin out of said vertical support and sliding the sleeves along the vertical supports to enable the hand grip to be placed in position at an adjustable distance from the arm support and thereafter releasing the pin into the closest pair of aligned apertures in the sleeves and vertical supports to fix the hand grip in the adjusted position.

5. The crutch of claim 4 further having a cavity within the end portion defined by the sleeve at one end and by a stop at the other end, the cavity receiving the spring.

6. The crutch of claim 5 wherein the force required to disengage the pin from the aperture in the vertical support is at least 5 pounds.

7. An adjustable hand grip having a locking member for an orthopedic crutch with a pair of generally parallel tubular vertical supports rigidly attached to one another, with each of the supports having a plurality of spaced apertures along a longitudinal surface, comprising:

a. a sleeve slidably surrounding each vertical support, each sleeve having an aperture that can be aligned with the apertures in the vertical support;

b. a bracket extending between the vertical supports to rigidly connect the sleeves;

c. an end portion extending from the sleeve;

d. a cavity within the end portion defined by the sleeve at one end and by a stop at the other end;

e. an end cap surrounding the end portion, the end cap retaining a pin; and, f. a spring received within the cavity and surrounding a portion of the pin to bias the pin inwardly through the aligned apertures in the sleeve and the vertical support, the pin being movable into and out of the vertical support, the locking member firmly fixing the hand grip to the vertical supports when the pin is extended through the aligned apertures in the sleeve and the vertical support.

* * * * *